US008810153B2

(12) United States Patent
Yoshio et al.

(10) Patent No.: US 8,810,153 B2
(45) Date of Patent: Aug. 19, 2014

(54) LED POWER SUPPLY SYSTEMS AND METHODS

(75) Inventors: Katsura Yoshio, Osaka (JP); Yasuo Matsumura, Kyoto (JP)

(73) Assignee: Texas Instruments Incorporation, Dallas, TX (US)

( * ) Notice: Subject to any disclaimer, the term of this patent is extended or adjusted under 35 U.S.C. 154(b) by 289 days.

(21) Appl. No.: 13/182,000

(22) Filed: Jul. 13, 2011

(65) Prior Publication Data

US 2012/0013267 A1 Jan. 19, 2012

Related U.S. Application Data

(60) Provisional application No. 61/365,134, filed on Jul. 16, 2010.

(51) Int. Cl.
*H05B 37/02* (2006.01)

(52) U.S. Cl.
USPC ..... 315/294; 315/185 R; 315/299; 315/308

(58) Field of Classification Search
USPC ..... 315/185 R, 193, 209 R, 210, 226, 291, 315/294, 299, 307, 308
See application file for complete search history.

(56) References Cited

U.S. PATENT DOCUMENTS

| | | | | |
|---|---|---|---|---|
| 6,864,641 | B2 * | 3/2005 | Dygert | 315/216 |
| 7,777,704 | B2 * | 8/2010 | S et al. | 345/82 |
| 7,944,189 | B2 | 5/2011 | Murakami | |
| 2009/0128045 | A1 * | 5/2009 | Szczeszynski et al. | 315/185 R |
| 2010/0013412 | A1 * | 1/2010 | Archibald et al. | 315/294 |

FOREIGN PATENT DOCUMENTS

| | | | |
|---|---|---|---|
| JP | 2009-283542 | A | 12/2009 |
| JP | 2010-177531 | A | 8/2010 |
| JP | 2011-029463 | A | 2/2011 |

* cited by examiner

*Primary Examiner* — Thuy Vinh Tran
(74) *Attorney, Agent, or Firm* — William B. Kempler; Frederick J. Telecky, Jr.

(57) ABSTRACT

One aspect of the present invention includes a light-emitting diode (LED) power supply system. The system includes an LED regulator configured to monitor at least one LED voltage associated with a respective at least one activated LED string and to generate an LED regulation voltage based on the at least one LED voltage relative to an LED power voltage that provides power to the at least one activated LED string. The system also includes a power converter configured to generate the LED power voltage and to regulate the LED power voltage based on the LED regulation voltage.

17 Claims, 3 Drawing Sheets

LED POWER SUPPLY SYSTEMS AND METHODS

RELATED APPLICATIONS

This application claims priority to provisional application 61/365,134, filed on Jul. 16, 2010, the entire contents of which is incorporated herein by reference.

TECHNICAL FIELD

The present invention relates generally to electronic circuits, and specifically to light-emitting diode (LED) power supply systems and methods.

BACKGROUND

The use of light-emitting diode (LED) strings instead of fluorescent bulbs for use in illumination of a backlight for a display, such as a television or a monitor for a laptop computer is increasing drastically based on consumer demands for better picture quality. In addition, typical LED light efficacy can be much better than conventional lighting systems for such displays, thus consuming significantly less power. In addition, among other advantages, LED systems can be smaller and more environmentally friendly, and can have a faster response with less electro-magnetic interference (EMI) emissions.

A number of LED regulation techniques exist for typical LED systems, such as constant-current regulation, constant-voltage regulation, and a combination of constant-current/constant-voltage regulation. The typical LED regulation schemes each have separate advantages and disadvantages. For example, some of the LED regulation schemes sacrifice cost for design simplicity. Other schemes are less expensive, but have a much slower dimming frequency. Yet other schemes have sufficient dimming capability but are less efficient with respect to power consumption and may also have more complicated circuit designs and implementations.

SUMMARY

One aspect of the present invention includes a light-emitting diode (LED) power supply system. The system includes an LED regulator configured to monitor at least one LED voltage associated with a respective at least one activated LED string and to generate an LED regulation voltage based on the at least one LED voltage relative to an LED power voltage that provides power to the at least one activated LED string. The system also includes a power converter configured to generate the LED power voltage and to regulate the LED power voltage based on the LED regulation voltage.

Another embodiment of the present invention includes a method for regulating power in a light-emitting diode (LED) power supply system. The method includes activating at least one of a plurality of LED strings to provide power from an LED power voltage to the activated at least one of the plurality of LED strings and monitoring at least one LED voltage associated with the respective activated at least one of the plurality of LED strings. The method also includes comparing the at least one LED voltage with at least one threshold voltage and determining whether the LED power voltage should one of increase and decrease based on the comparison of the at least one LED voltage with the at least one threshold voltage. The method further includes regulating the LED power voltage based on the determination and based on a predetermined reference voltage.

Another embodiment of the present invention includes an LED power supply system. The system includes a power converter configured to generate and regulate an LED power voltage that provides power to at least one activated LED string based on a feedback voltage relative to a predetermined reference voltage. An LED regulator configured to monitor at least one LED voltage associated with a respective at least one activated LED string and to generate an LED regulation voltage that is indicative of whether the LED power voltage should one of increase to provide sufficient power for each of the at least one activated LED string, decrease to substantially minimize power consumption of each of the at least one activated LED string, and remain the same magnitude. The LED regulation voltage can be combined with the LED power voltage via respective first and second feedback paths to generate the feedback voltage.

DETAILED DESCRIPTION

The present invention relates generally to electronic circuits, and specifically to light-emitting diode (LED) power supply systems and methods. An LED power supply system includes a power converter that is configured to generate and regulate an LED power voltage that is configured to provide power to activated LED strings. The power converter can be configured as any of a variety of power converters that generate voltage, such as via current flow through one or more inductors or from one or more capacitors, based on comparing a feedback voltage to a predetermined reference voltage, such as a boost converter. The LED power supply system also includes an LED regulator. The LED regulator is configured to monitor an LED voltage associated with each of the activated LED strings, such as relative to the LED power voltage. The monitoring of the LED voltage can be based on monitoring a voltage of an activation switch, such as a drain voltage of a field-effect transistor (FET), such that the LED voltage can be a voltage associated with a difference between the LED power voltage and a voltage drop across the LED string.

The LED regulator can be configured to compare the LED voltage with one or more thresholds to determine whether the LED power voltage should increase to provide sufficient voltage to the activated LED strings or decrease to substantially minimize power consumption of the activated LED strings. The LED regulator can generate an LED regulation voltage, such as based on a digital control loop that is indicative of whether the LED power voltage should increase, decrease, or maintain a current magnitude. The LED regulator can update the digital increments associated with increasing or decreasing the LED power voltage at varying response times based on the indication of an increase or decrease in the LED power voltage. As an example, the variable response rate can be based on updating the digital increments associated with increasing the LED power voltage at a faster response rate, such as based on a more rapid sampling rate, and updating the digital increments associated with decreasing the LED power voltage at slower response rate, such as based on a slower sampling rate. The LED regulator can also maintain the magnitude of the LED regulation voltage, even after one or more of the LED strings are deactivated. The LED regulation voltage can be provided via a first feedback loop to be combined with a voltage associated with the LED power voltage via a second feedback loop to generate the feedback voltage. Thus, the power converter can regulate the LED power voltage based on the feedback voltage, such as relative to a predetermined reference voltage.

Figure 1:
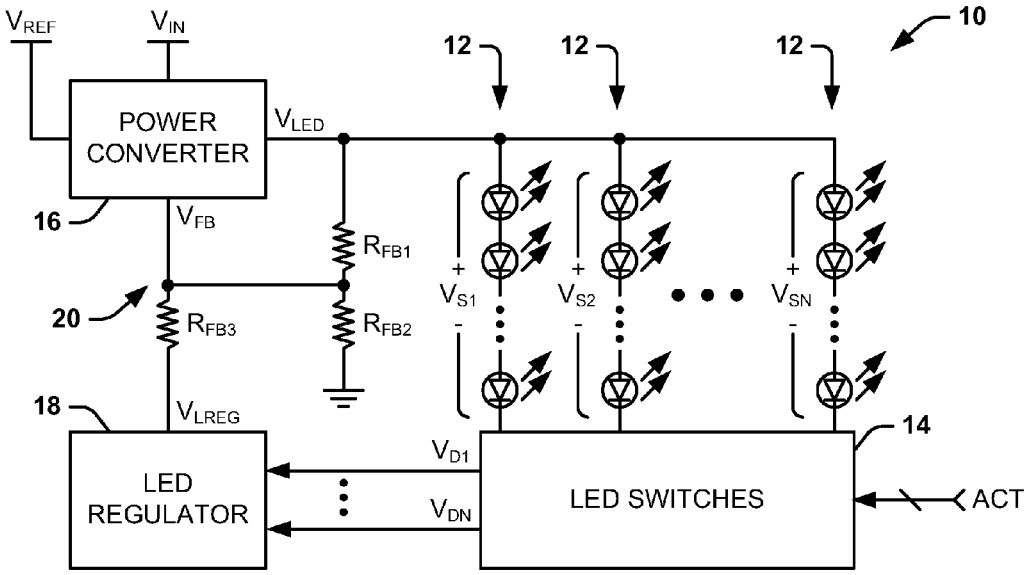
FIG. 1 illustrates an example of a light-emitting diode (LED) power supply system in accordance with an aspect of the invention.

FIG. 1 illustrates an example of an LED power supply system 10 in accordance with an aspect of the invention. The LED power supply system 10 can be implemented in any of a variety of LED power applications, such as for television and large event venue displays. The LED power supply system 10 is configured to generate an LED power voltage $V_{LED}$ that provides power to a plurality N of LED strings 12, where N is a positive integer. The LED strings 12 can be selectively activated by a set of LED switches 14 via a respective set of activation signals ACT. As an example, the activation signals ACT can be provided by an external processor or controller (not shown). Thus, the LED strings 12 can be selectively activated to illuminate a display, such as a computer monitor, television, or large display screen.

The LED power supply system 10 includes a power converter 16 configured to generate and regulate the LED power voltage $V_{LED}$. As an example, the power converter 16 can be arranged as a boost power converter that is configured to generate the LED power voltage $V_{LED}$ based on conducting a current through an inductor from an input voltage $V_{IN}$ and periodically discharging the inductor via a switch (not shown). The power converter 16 can be configured to regulate the magnitude of the LED power voltage $V_{LED}$ based on comparing a feedback voltage $V_{FB}$ with a predetermined reference voltage $V_{REF}$. Thus, the LED power voltage $V_{LED}$ can be provided to power the LED strings 12, such that upon activation via the respective LED switches 14, a current can be conducted through the activated LED strings 12 to illuminate the activated LED strings 12. In response to conducting the current, a voltage drop is induced on the activated LED strings 12, demonstrated in the example of FIG. 1 as voltages $V_{S1}$ through $V_{SN}$, respectively. While the example of FIG. 1 is described with respect to all of the plurality N of the LED strings 12, it is to be understood that at any given time, it is possible that less than all of the plurality N of the LED strings 12 may be activated. Therefore, it is to be understood that the power converter 16 may regulate the LED power voltage $V_{LED}$ based only on the activated LED strings 12.

The power supply system 10 also includes an LED regulator 18. As an example, the LED regulator 18 can be configured as an integrated circuit (IC), such that it can be easily incorporated into existing LED power supply topologies. The LED regulator 18 is configured to monitor LED voltages $V_{D1}$ through $V_{DN}$ associated with each of the respective activated LED strings 12. As an example, the LED voltages $V_{D1}$ through $V_{DN}$ can be voltages of the respective activated LED switches 14, such as drain voltages for FETs or collector voltages for bipolar junction transistors (BJTs), to conduct the current through the respective LED string 12 to provide the respective voltages $V_{S1}$ through $V_{SN}$ across the respective activated LED strings 12. Therefore, the LED voltages $V_{D1}$ through $V_{DN}$ can be voltages that are associated with a difference between the LED power voltage $V_{LED}$ and the respective voltages $V_{S1}$ through $V_{SN}$. The LED regulator 18 can thus compare the LED voltages $V_{D1}$ through $V_{DN}$ with one or more thresholds to determine if the LED power voltage is sufficient for powering the activated LED strings 12 and/or has a magnitude that substantially minimizes power consumption associated with the activated LED strings 12. Therefore, the LED regulator 18 determines whether the LED power voltage $V_{LED}$ should increase to provide sufficient voltage for all of the activated LED strings 12, should decrease to minimize the power consumption of the activated LED strings 12, or should be maintained at a current magnitude.

As an example, the LED regulator 18 can include a plurality of comparators configured to compare each of the LED voltages $V_{D1}$ through $V_{DN}$ with each of high and low predetermined threshold voltages. For example, the predetermined high threshold voltage can be associated with a maximum voltage associated with the LED voltages $V_{D1}$ through $V_{DN}$ for optimizing efficiency of the LED strings 12. Similarly, the predetermined low threshold voltage can be associated with a minimum voltage associated with the LED voltages $V_{D1}$ through $V_{DN}$ for ensuring that the LED strings 12 have sufficient power for operation. Thus, the LED regulator 18 can include logic that dictates whether the LED power voltage $V_{LED}$ should increase, decrease, or remain unchanged based on the respective comparisons of the LED voltages $V_{D1}$ through $V_{DN}$ with the predetermined high and low threshold voltages.

The LED regulator 18 can be configured to generate an LED regulation voltage $V_{LREG}$ that is indicative of whether the LED power voltage $V_{LED}$ should increase, decrease, or remain unchanged. For example, the LED regulation voltage $V_{LREG}$ can have a magnitude that is inversely proportional to the LED power voltage $V_{LED}$, such that a lower magnitude of the LED regulation voltage $V_{LREG}$ can be indicative of a greater magnitude of the LED power voltage $V_{LED}$ and vice-versa. The LED regulation voltage $V_{LREG}$ is combined with the LED power voltage $V_{LED}$ via a set of feedback resistors to generate the feedback voltage $V_{FB}$ at a feedback node 20 based on which the power converter 16 regulates the LED power voltage $V_{LED}$. In the example of FIG. 1, the LED power voltage $V_{LED}$ is provided to the feedback node 20 via a voltage-divider formed by resistors $R_{FB1}$ and $R_{FB2}$, and the LED regulation voltage $V_{LREG}$ is provided to the feedback node 20 via a voltage-divider formed by resistors $R_{FB3}$ and $R_{FB2}$. Therefore, the feedback voltage $V_{FB}$ has a magnitude that is based on both the LED regulation voltage $V_{LREG}$ and the LED power voltage $V_{LED}$.

Accordingly, the power converter 16 can regulate the LED power voltage $V_{LED}$ based on the feedback voltage $V_{FB}$ that is associated with both the LED regulation voltage $V_{LREG}$ and the LED power voltage $V_{LED}$ itself. As a result, the power supply system 10 can operate with substantially improved efficiency relative to typical LED power supply systems. For example, the power converter 16 can set an initial magnitude of the LED power voltage $V_{LED}$, such that the LED regulator 18 can subsequently command the power converter 16 to reduce the LED power voltage $V_{LED}$ to an optimal magnitude to reduce both DC and transient power losses of the LED strings 12. As a result, the LED power supply system 10 provides the advantage of providing a most power efficient operation of the LED strings 12. In addition, because the LED power voltage $V_{LED}$ can be regulated to a magnitude that is marginally greater than the voltage necessary to bias the respective activated LED strings 12, the LED power supply system 10 can be implemented for applications that require very rapid switching of the LED strings 12. Furthermore, as described in greater detail below, the LED power supply system 10 can support very rapid transients associated with varying the activation of the LED strings 12, and thus the magnitude of the LED power voltage $V_{LED}$ necessary to provide sufficient power to the activated LED strings 12.

Figure 2:
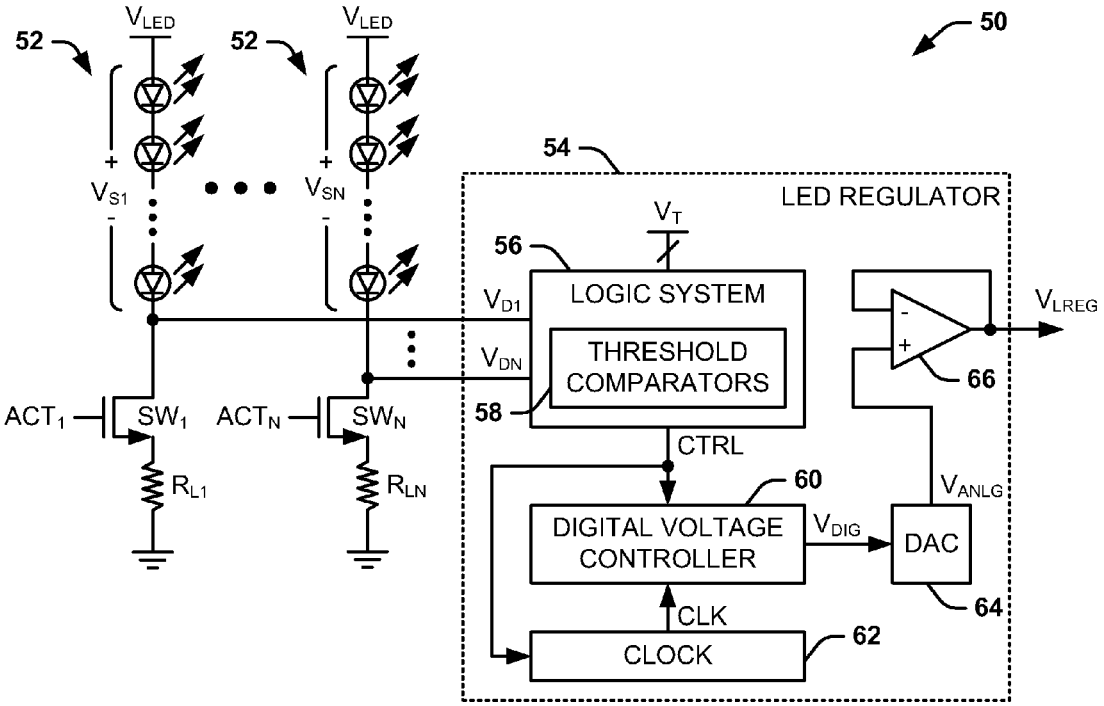
FIG. 2 illustrates another example of an LED power supply system in accordance with an aspect of the invention.

FIG. 2 illustrates another example of an LED power supply system 50 in accordance with an aspect of the invention. The LED power supply system 50 includes a plurality N of LED strings 52 and an LED regulator 54. As an example, the LED strings 52 and the LED regulator 54 can correspond to the LED strings 12 and the LED regulator 18 in the example of FIG. 1. Therefore, reference is to be made to the example of FIG. 1 in the following description of the example of FIG. 2.

The LED strings 52 each include a plurality of series-connected LEDs that are powered by the LED power voltage $V_{LED}$, such as regulated by the power converter 16. The LED strings 52 are each coupled to a drain of respective switches $SW_1$ through $SW_N$, which are demonstrated in the example of FIG. 2 as N-type FETs and which can correspond to the switches 14 in the example of FIG. 1. The switches $SW_1$ through $SW_N$ are coupled to ground via respective source resistors $R_{L1}$ through $R_{LN}$ and are activated via respective activation signals $ACT_1$ through $ACT_N$, such as generated by a processor. Thus, upon activation, a voltage drop $V_{S1}$ through $V_{SN}$ corresponding to a sum of the bias voltages of each of the LEDs in the respective LED strings 52 develops across the respective LED strings 52.

The LED regulator 54 includes a logic system 56 that is configured to monitor the LED voltages $V_{D1}$ through $V_{DN}$. In the example of FIG. 2, the LED voltages $V_{D1}$ through $V_{DN}$ are drain voltages associated with each of the switches $SW_1$ through $SW_N$. Therefore, the LED voltages $V_{D1}$ through $V_{DN}$ are voltages corresponding to a difference between the LED power voltage $V_{LED}$ and the respective voltages $V_{S1}$ through $V_{SN}$. The logic system 56 includes a plurality of threshold comparators 58 that are configured to compare the LED voltages $V_{D1}$ through $V_{DN}$ with one or more predetermined threshold voltages $V_T$. As an example, the threshold voltages $V_T$ can be associated with a predetermined high threshold voltage and a predetermined low threshold voltage. Thus, the logic system 56 can determine which and how many of the LED voltages $V_{D1}$ through $V_{DN}$ have a magnitude that is greater than the predetermined high threshold, that is less than the predetermined threshold, and that is between the predetermined high and low threshold voltages. Accordingly, the logic system 56 can generate a control signal CTRL that is indicative of whether the LED power voltage $V_{LED}$ should increase, decrease, or remain unchanged based on the determination. As an example, the control signal CTRL can be configured as a digital signal.

Figure 3:
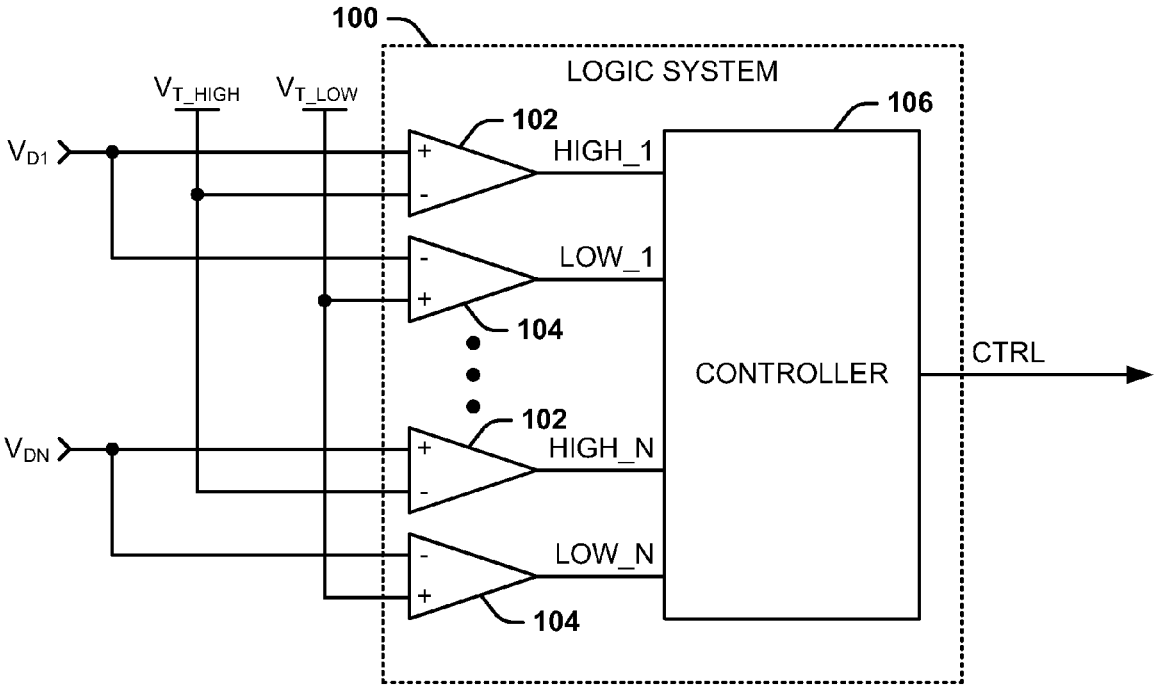
FIG. 3 illustrates an example of a logic system in accordance with an aspect of the invention.

FIG. 3 illustrates an example of a logic system 100 in accordance with an aspect of the invention. The logic system 100 can be configured substantially similar to the logic system 56 in the example of FIG. 2. Therefore, reference is to be made to the example of FIG. 2 in the following description of the example of FIG. 3.

The logic system 100 includes a plurality of comparators arranged in pairs. In the example of FIG. 3, a first comparator 102 of each pair is configured to compare a respective one of the LED voltages $V_{D1}$ through $V_{DN}$ with a high threshold voltage $V_{T_HIGH}$, and a second comparator 104 of each pair is configured to compare a respective one of the LED voltages $V_{D1}$ through $V_{DN}$ with a low threshold voltage $V_{T_LOW}$. Thus, the comparators 102 and 104 can correspond to the threshold comparators 58 in the example of FIG. 2. As an example, the high threshold voltage $V_{T_HIGH}$ can be associated with a maximum voltage associated with the LED voltages $V_{D1}$ through $V_{DN}$ for optimizing efficiency of the LED strings 52. Similarly, the low threshold voltage $V_{T_LOW}$ can be associated with a minimum voltage associated with the LED voltages $V_{D1}$ through $V_{DN}$ for ensuring that the LED strings 52 have sufficient power for operation. While the example of FIG. 3 demonstrates that the comparators 102 and 104 monitor the LED voltages $V_{D1}$ through $V_{DN}$ directly, it is to be understood that the comparators 102 and 104 could be configured to monitor scaled versions of the LED voltages $V_{D1}$ through $V_{DN}$, such as by implementing voltage-dividers and/or clamp diodes.

The comparators 102 are arranged such that the respective LED voltages $V_{D1}$ through $V_{DN}$ are provided to a non-inverting input and the high threshold voltage $V_{T_HIGH}$ is provided to an inverting input. Similarly, the comparators 104 are arranged such that the respective LED voltages $V_{D1}$ through $V_{DN}$ are provided to an inverting input and the low threshold voltage $V_{T_LOW}$ is provided to a non-inverting input. Therefore, the comparators 102 are configured to assert respective signals HIGH_1 through HIGH_N with a logic-high (i.e., logic 1) binary state in response to the respective LED voltages $V_{D1}$ through $V_{DN}$ being greater than the high threshold voltage $V_{T_HIGH}$. Similarly, the comparators 104 are configured to assert respective signals LOW_1 through LOW_N with a logic-high binary state in response to the respective LED voltages $V_{D1}$ through $V_{DN}$ being less than the low threshold voltage $V_{T_LOW}$. Accordingly, if a given one of the LED voltages $V_{D1}$ through $V_{DN}$ has a magnitude that is between the high and low threshold voltages $V_{T_HIGH}$ and $V_{T_LOW}$, then both of the comparators 102 and 104 de-assert the respective signals HIGH and LOW with a logic-low (i.e., logic 0) binary state.

The sets of signals HIGH_1 through HIGH_N and LOW_1 through LOW_N are provided to a controller 106. The controller 106 is configured to determine whether the LED power voltage $V_{LED}$ should increase, decrease, or remain unchanged based on the combination of comparisons performed by the comparators 102 and 104. As an example, the controller 106 can be configured to determine that the LED power voltage $V_{LED}$ should increase if one or more of the LED voltages $V_{D1}$ through $V_{DN}$ are less than the low threshold voltage $V_{T_LOW}$ and to determine that the LED power voltage $V_{LED}$ should decrease if all of the LED voltages $V_{D1}$ through $V_{DN}$ are greater than the high threshold voltage $V_{T_HIGH}$. Thus, the controller 106 can determine that the LED power voltage $V_{LED}$ should maintain a current magnitude in response to at least one of the LED voltages $V_{D1}$ through $V_{DN}$ having a magnitude that is between the high and low threshold voltages $V_{T_HIGH}$ and $V_{T_LOW}$ and in response to none of the LED voltages $V_{D1}$ through $V_{DN}$ having a magnitude that is less than the low threshold voltage $V_{T_LOW}$. Referring back to the example of FIG. 3, upon determining whether the LED power voltage $V_{LED}$ should increase, decrease, or remain unchanged based on the comparisons of the comparators 12 and 104, the controller 106 is configured to generate the control signal CTRL that is indicative of the determination. As an example, the control signal CTRL can be a digital signal that is merely indicative of whether the LED power voltage $V_{LED}$ should increase, decrease, or remain unchanged.

Figure 4:
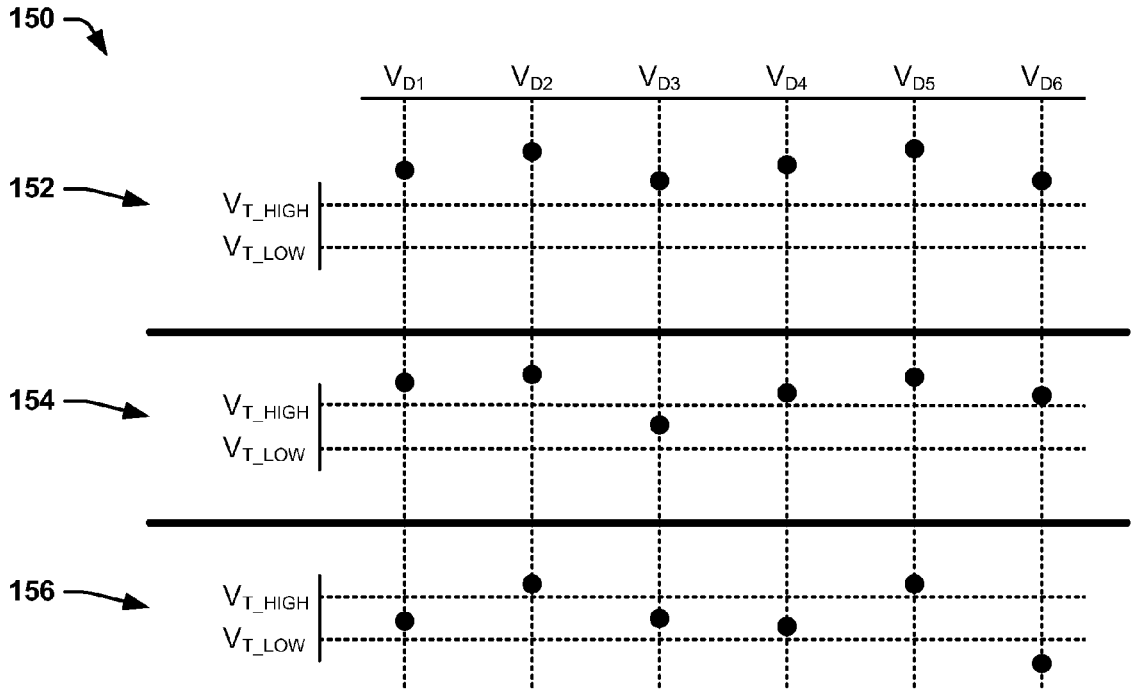
FIG. 4 illustrates an example of a diagram for demonstrating LED power regulation in accordance with an aspect of the invention.

FIG. 4 illustrates an example of a diagram 150 for demonstrating LED power regulation in accordance with an aspect of the invention. The diagram 150 can correspond to a manner in which the controller 106 in the example of FIG. 3 determines whether the LED power voltage $V_{LED}$ should increase, decrease, or remain unchanged. In the example of FIG. 4, the diagram 150 demonstrates relative magnitudes of six LED voltages, demonstrated as $V_{D1}$ through $V_{D6}$, relative to the high threshold voltage $V_{T_HIGH}$ and the low threshold voltage $V_{T_LOW}$. It is to be understood that the voltages are demonstrated in such a manner as to illustrate relative magnitudes, and are not intended to show specific magnitudes of the voltages $V_{D1}$ through $V_{D6}$ or of the threshold voltages $V_{T_HIGH}$ and $V_{T_LOW}$.

The diagram 150 demonstrates a first scenario 152, a second scenario 154, and a third scenario 156. In the first scenario 152, all of the LED voltages $V_{D1}$ through $V_{D6}$ are demonstrated as having magnitudes that are greater than the high threshold voltage $V_{T_HIGH}$. Therefore, in response to the first scenario 152, the controller 106 can determine that the LED power voltage $V_{LED}$ is too high, such that the LED power voltage $V_{LED}$ should be decreased to substantially minimize DC and transient power losses through the respective LED strings 52. In addition, by reducing the LED power voltage $V_{LED}$ while still maintaining sufficient operating voltage for the LED strings 52, additional cost savings can be implemented based on the omission of thermal control components. For example, the difference between the LED power voltage $V_{LED}$ and a minimum voltage necessary for biasing the LED strings 52 is directly proportional to a temperature buildup within the associated display, such as requiring thermal control components to reduce the temperature buildup in typical display systems. However, by reducing the LED power voltage $V_{LED}$ in the first scenario 152, some or all of the thermal control components can be omitted based on the operation of the LED power supply system 10.

In the second scenario 154, the LED voltages $V_{D1}$, $V_{D2}$, and $V_{D4}$ through $V_{D6}$ are demonstrated as having magnitudes that are greater than the high threshold voltage $V_{T_HIGH}$, while the LED voltage $V_{D3}$ has a magnitude that is between the threshold voltages $V_{T_HIGH}$ and $V_{T_LOW}$. Therefore, in response to the second scenario 154, the controller 106 can determine that the magnitude of the LED power voltage $V_{LED}$ should be maintained, such that the magnitude of the LED power voltage $V_{LED}$ is acceptable for efficient operation of the LED strings 52. It is to be understood that the second scenario 154 could include more than one of the LED voltages $V_{D1}$ through $V_{D6}$ being between the threshold voltages $V_{T_HIGH}$ and $V_{T_LOW}$. In the third scenario 156, the LED voltages $V_{D2}$ and $V_{D5}$ are demonstrated as having magnitudes that are greater than the high threshold voltage $V_{T_HIGH}$, the LED voltages $V_{D1}$, $V_{D3}$, and $V_{D4}$ are demonstrated as having magnitudes that are between the threshold voltages $V_{T_HIGH}$ and $V_{T_LOW}$, and the LED voltage $V_{D6}$ is demonstrated as having a magnitude that is less than the low threshold voltage $V_{T_LOW}$. Therefore, in response to the third scenario 156, the controller 106 can determine that the LED power voltage $V_{LED}$ is too low, such that the LED power voltage $V_{LED}$ should be increased to ensure that the LED strings 52 (i.e., the respective LED string 52 associated with the LED voltage $V_{D6}$) have sufficient power to be biased for operation.

Referring back to the example of FIG. 2, the control signal CTRL is provided from the logic system 56 to a digital voltage controller 60. The digital voltage controller 60 is configured to generate a digital voltage signal $V_{DIG}$ that corresponds to a digital representation of the LED regulation voltage $V_{LREG}$. As an example, the digital voltage controller 60 can be configured an up/down counter that can increase or decrease the digital voltage signal $V_{DIG}$ by a predetermined voltage increment in response to the digital control signal CTRL. As an example, upon the digital control signal CTRL commanding an increase in the LED power voltage $V_{LED}$, the digital voltage controller 60 can decrease the digital voltage signal $V_{DIG}$ by the predetermined voltage increment. Similarly, upon the digital control signal CTRL commanding a decrease in the LED power voltage $V_{LED}$, the digital voltage controller 60 can increase the digital voltage signal $V_{DIG}$ by the predetermined voltage increment.

In the example of FIG. 2, the LED regulator 54 includes a clock 62 configured to generate a clock signal CLK. The clock signal CLK is provided to digital voltage controller 60, such that the frequency of the clock signal CLK can be implemented to sample the control signal CTRL for purposes of increasing and/or decreasing the digital voltage signal $V_{DIG}$. In the example of FIG. 2, the clock 62 likewise receives the control signal CTRL as an input, such that the clock 62 can set the frequency of the clock signal CLK based on control signal CTRL. For example, in response to the control signal CTRL indicating that the LED power voltage $V_{LED}$ should decrease, the clock 62 can set the frequency of the clock signal CLK to a lesser value, such that the digital voltage controller 60 can sample the control signal CTRL at a lesser response rate (e.g., 1 mS). However, as another example, in response to the control signal CTRL indicating that the LED power voltage $V_{LED}$ should increase, the clock 62 can set the frequency of the clock signal CLK to a greater value, such that the digital voltage controller 60 can sample the control signal CTRL at a greater response rate (e.g., 13 μS). As an example, the digital voltage controller 60 can include a low-pass filter (LPF) for removing unnecessary and/or undesirable transient changes in the control signal CTRL. Furthermore, while the example of FIG. 2 demonstrates sampling the control signal CTRL based on the clock signal CTRL, it is to be understood that the variable response rate can be accomplished based on varying the frequency response of the LPF, or by any of a variety of other manners for changing the response rate in accordance with system requirements.

As a result of the change in sampling rate of the digital voltage controller 60 based on the clock signal CLK, the power converter 16 can be configured to respond more quickly to a demand for an increase in the LED power voltage $V_{LED}$ to provide sufficient power to the activated LED strings 52. As a result, for example, current through a boost inductor of the power converter 16 can rapidly increase to provide the sufficient LED power voltage $V_{LED}$ for the activated LED strings 52. On the other hand, the power converter 16 can similarly be configured to reduce the LED power voltage $V_{LED}$ more slowly in response to too great a magnitude of the LED power voltage $V_{LED}$, such that the power converter can operate in a stable manner and thermal effects of the LED power supply system 10 can likewise be optimized.

The digital voltage signal $V_{DIG}$ is provided to a digital-to-analog converter (DAC) 64 that is configured to convert the digital voltage signal $V_{DIG}$ to an analog equivalent voltage $V_{ANLG}$. The analog voltage $V_{ANLG}$ can thus correspond to an instantaneous magnitude of the LED regulation voltage $V_{LREG}$. The analog voltage $V_{ANLG}$ is provided to a holding buffer amplifier 66 that is arranged, for example, as a unity gain amplifier. The holding buffer amplifier 66 is thus configured to generate the LED regulation voltage $V_{LREG}$ based on holding the magnitude of the $V_{ANLG}$. Therefore, the holding buffer amplifier 66 can maintain the magnitude of the LED regulation voltage $V_{LREG}$ even in response to deactivation of one or more of the LED strings 52. As a result, the power converter 16 can continue to regulate the LED power voltage $V_{LED}$ based on the magnitude of the LED regulation voltage $V_{LREG}$ after deactivation of the LED strings 52, such that the LED strings 52 should still have sufficient power from the LED power voltage $V_{LED}$ when instantly reactivated. It is to be understood that any of a variety of other devices or control techniques can be implemented instead of the holding buffer amplifier 66 to maintain the magnitude of the LED regulation voltage $V_{LREG}$ even in response to deactivation of one or more of the LED strings 52.

Thus, the LED power voltage $V_{LED}$ is provided via a first feedback path (i.e., via the feedback resistors $R_{FB1}$ and $R_{FB2}$) to be combined with the LED regulation voltage $V_{LREG}$ that is provided via a second feedback path that includes the LED strings 52 and the LED regulator 54 to generate the feedback voltage $V_{FB}$. Accordingly, the power converter 16 in the example of FIG. 1 can regulate the LED power voltage $V_{LED}$ based on the feedback voltage $V_{FB}$ relative to the predetermined reference voltage $V_{REF}$. Specifically, in the example of FIG. 1, if the feedback voltage $V_{FB}$ is fixed to the predetermined reference voltage $V_{REF}$, the LED power voltage $V_{LED}$ can be defined as follows:

$$V_{LED}=(R_{FB1}+R_{FB2})/R_{FB2}*V_{REF}+R_{FB1}/R_{FB3}*(V_{REF}-V_{LREG}) \quad \text{Equation 1}$$

For example, upon the LED regulator 54 determining that the LED power voltage $V_{LED}$ is too high for efficient operation of the LED strings 52, the LED regulator 54 decreases the LED regulation voltage, and thus the feedback voltage $V_{FB}$, prompting the power converter 16 to regulate the LED power voltage $V_{LED}$ to a lesser magnitude. Similarly, upon the LED regulator 54 determining that the LED power voltage $V_{LED}$ is too low for providing sufficient power to the LED strings 52, the LED regulator 54 increases the LED regulation voltage, and thus the feedback voltage $V_{FB}$, prompting the power converter 16 to regulate the LED power voltage $V_{LED}$ to a greater magnitude. Accordingly, based on the LED regulator 54, the power supply system 10 can regulate the LED power voltage $V_{LED}$ based on the LED regulation voltage for a most optimal efficiency of the LED strings 52.

It is to be understood that the power supply systems 10 and 50 are not intended to be limited to the examples of FIGS. 1 and 2. As an example, the power supply systems 10 and 50 are not intended to be limited to implementing the power converter 16, such as arranged as a boost converter, but could instead implement any of a variety of other power regulation schemes, such as an LLC power scheme with primary or secondary side control. As another example, the LED strings 12 and 52 could be arranged as current-mode controlled LED strings, such as via a current amplifier, such that the LED voltages $V_{D1}$ through $V_{DN}$ can be cathode node voltages that are monitored by the LED regulators 18 and 54. As yet another example, the activation signals $ACT_1$ through $ACT_N$ for the respective switches $SW_1$ through $SW_N$ can be generated in the LED regulators 18 and 56, such as based on a processor or controller therein. As a further example, the clock 62 can be implemented in the logic system 62 to change the sampling rate of the LED voltages $V_{D1}$ through $V_{DN}$ instead of being implemented in the LED regulator 56 to change the sampling rate of the control signal CTRL. Thus, the power supply systems 10 and 50 can be configured in any of a variety of ways.

Figure 5:
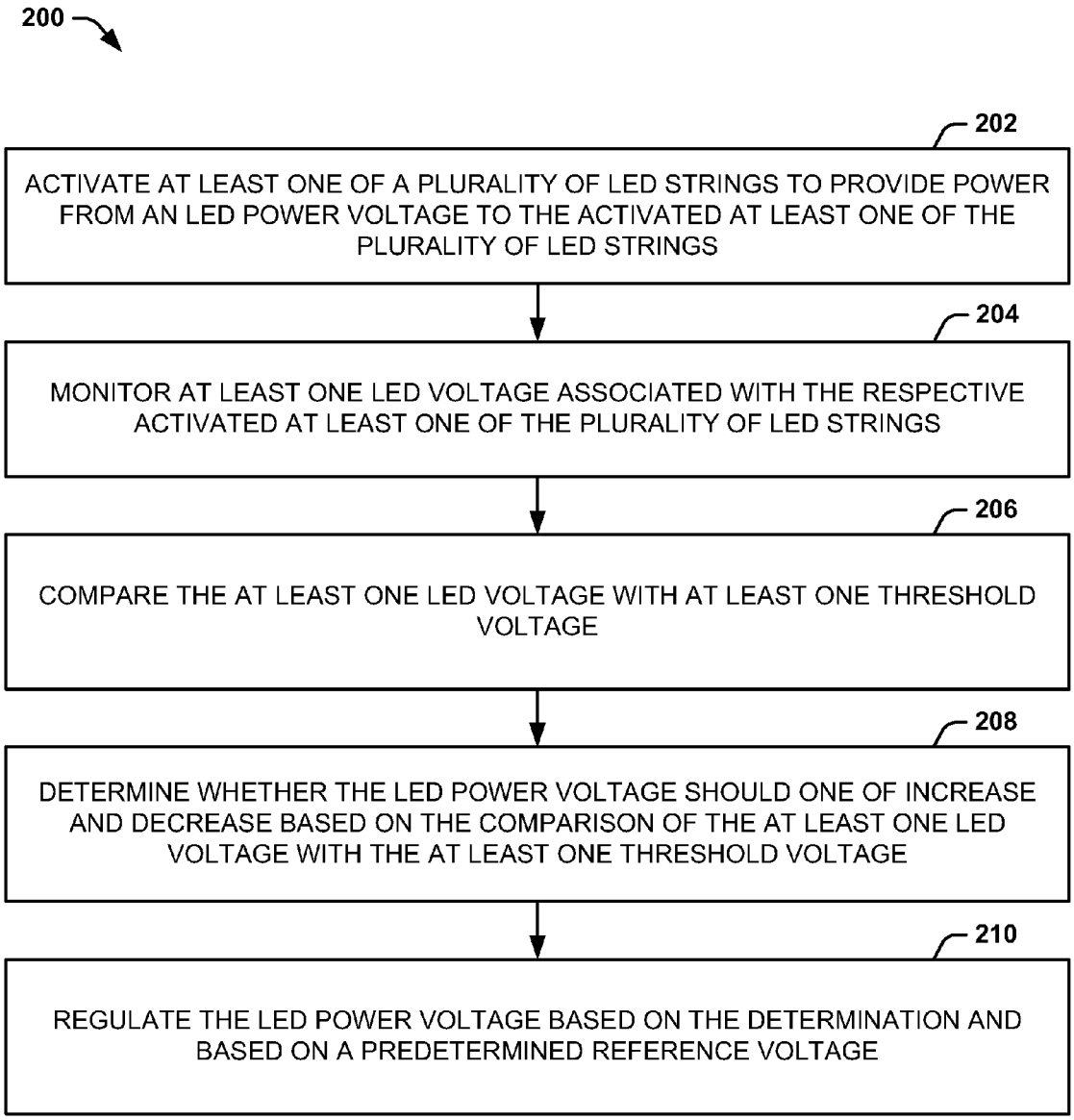
FIG. 5 illustrates an example of a method for regulating power in an LED power supply system in accordance with an aspect of the invention.

In view of the foregoing structural and functional features described above, certain methods will be better appreciated with reference to FIG. 5. It is to be understood and appreciated that the illustrated actions, in other embodiments, may occur in different orders and/or concurrently with other actions. Moreover, not all illustrated features may be required to implement a method.

FIG. 5 illustrates an example of a method 200 for regulating power in an LED power supply system. At 202, at least one of a plurality of LED strings is activated to provide power from an LED power voltage to the activated at least one of the plurality of LED strings. The LED power voltage can be generated from a power converter, such as a boost power converter. At 204, at least one LED voltage associated with the respective activated at least one of the plurality of LED strings is activated. The activation can be via a respective activation signal, such as generated from a processor. At 206, the at least one LED voltage is compared with at least one threshold voltage. The at least one threshold voltage can include a predetermined high threshold voltage and a predetermined low threshold voltage.

At 208, it is determined whether the LED power voltage should one of increase and decrease based on the comparison of the at least one LED voltage with the at least one threshold voltage. The LED power voltage can be determined to increase based on one or more of the at least one LED voltage being less than a low threshold voltage. The LED power voltage can be determined to decrease based on all of the at least one LED voltage being greater than a high threshold voltage. The LED power voltage can be determined to remain unchanged based on one or more of the at least one LED voltage being between the high and low threshold voltages, and none of the at least one LED voltage being less than the low threshold voltage. At 210, the LED power voltage is regulated based on the determination and based on a predetermined reference voltage. The determination can be used to generate an LED regulation voltage that is combined with the LED power voltage to generate a feedback voltage, such that the LED power voltage is regulated based on the feedback voltage relative to the predetermined reference voltage.

What have been described above are examples of the invention. It is, of course, not possible to describe every conceivable combination of components or method for purposes of describing the invention, but one of ordinary skill in the art will recognize that many further combinations and permutations of the invention are possible. Accordingly, the invention is intended to embrace all such alterations, modifications, and variations that fall within the scope of this application, including the appended claims.

What is claimed is:

1. A light-emitting diode (LED) power supply system comprising:

an LED regulator configured to monitor at least one LED voltage associated with a respective at least one activated LED string and to generate an LED regulation voltage based on the at least one LED voltage relative to an LED power voltage that provides power to the at least one activated LED string; and a power converter configured to generate the LED power voltage and to regulate the LED power voltage based on the LED regulation voltage, wherein the power converter is configured to regulate the LED power voltage based on both the LED regulation voltage and a predetermined reference voltage and wherein the power converter is configured to regulate the LED power voltage based on a feedback voltage having a magnitude that is based on both the LED power voltage in a first feedback loop and the LED regulation voltage in a second feedback loop, the power converter regulating the LED power voltage based on the feedback voltage relative to the predetermined reference voltage, the first feedback loop comprising a resistor ($R_{FB1}$) in series with a resistor ($R_{FB2}$) between the LED power voltage and a reference, the second feedback loop comprising the two feedback resistors of the first loop and a third resistor ($R_{FB3}$) according to the equation:

$$V_{LED}=(R_{FB1}+R_{FB2})/R_{FB2}*V_{REF}+R_{FB1}/R_{FB3}*(V_{REF}-V_{LREG})$$

in which $V_{LED}$ in the LED power voltage;

$R_{FB1}$ and $R_{FB2}$ are the feedback resistors of the first loop;

$R_{FB3}$ is the feedback resistor of the second loop;

$V_{LREG}$ is the LED regulation voltage; and $V_{REF}$ is the predetermined reference voltage.

2. The system of claim 1, wherein the LED regulator comprises a logic system configured to determine whether the LED power voltage should one of increase to provide sufficient power for each of the at least one activated LED string, decrease to substantially minimize power consumption of each of the at least one activated LED string, and remain unchanged, the logic system generating a control signal configured to adjust the LED regulation voltage based on the determination.

3. The system of claim 2, wherein the logic system comprises a plurality of comparators configured to perform at least one comparison of each of the at least one LED voltage with at least one predetermined threshold voltage, the control signal being generated based on the at least one comparison.

4. The system of claim 3, wherein the plurality of comparators are configured to compare each of the at least one LED voltage with each of a predetermined high threshold voltage and a predetermined low threshold, the control signal being generated based on the magnitude of each of the at least one LED voltage relative to the predetermined high threshold voltage and the predetermined low threshold.

5. The system of claim 4, wherein the logic system is configured to command an increase of the LED regulation voltage in response to one or more of the at least one LED voltage being less than the predetermined low threshold voltage, to command a decrease of the LED regulation voltage in response to all of the at least one LED voltage being greater than the predetermined high threshold voltage, and to command no change of the LED regulation voltage in response to none of the at least one LED voltage being less than the predetermined low threshold voltage and one or more of the at least one LED voltage being between the predetermined high and low threshold voltages via the command signal.

6. The system of claim 2, wherein the LED regulator further comprises:

a digital voltage controller configured to one of increase, decrease, and maintain a magnitude of a digital voltage signal in response to the control signal, the digital voltage signal corresponding to the LED regulator voltage; and a digital-to-analog controller (DAC) configured to convert the digital voltage signal to the LED regulation voltage.

7. The system of claim 2, wherein the LED regulator is further configured to maintain the magnitude of the LED regulation voltage in response to one or more of the at least one activated LED string being deactivated.

8. The system of claim 1, wherein the LED regulator is configured to change the magnitude of the LED regulation voltage by a predetermined increment at each sample of a first response rate based on determining that the LED power voltage should increase and to change the magnitude of the LED regulation voltage by the predetermined increment at each sample of a second response rate based on determining that the LED power voltage should decrease, the first response rate being faster than the second response rate.

9. A method for regulating power in a light-emitting diode (LED) power supply system, the method comprising:

activating at least one of a plurality of LED strings to provide power from an LED power voltage to the activated at least one of the plurality of LED strings;

monitor at least one LED voltage associated with the respective activated at least one of the plurality of LED strings;

comparing the at least one LED voltage with at least one threshold voltage;

determining whether the LED power voltage should one of increase and decrease based on the comparison of the at least one LED voltage with the at least one threshold voltage; and regulating the LED power voltage based on the determination and based on a predetermined reference voltage, wherein regulating the LED power voltage comprises:

generating a digital control signal that is configured to one of increase, decrease, and maintain a magnitude of a digital voltage signal;

converting the digital voltage signal to an analog LED regulation voltage;

combining the analog LED regulation voltage with the LED power voltage to generate a feedback voltage utilizing a first feedback loop comprising a resistor ($R_{FB1}$) in series with a resistor ($R_{FB2}$) between the LED power voltage and a reference, and a second feedback loop comprising the two feedback resistors of the first loop and a third resistor ($R_{FB3}$) according to the equation:

$$V_{LED}=(R_{FB1}+R_{FB2})/R_{FB2}*V_{REF}+R_{FB1}/R_{FB3}*(V_{REF}-V_{LREG})$$

in which $V_{LED}$ in the LED power voltage;

$R_{FB1}$ and $R_{FB2}$ are the feedback resistors of the first loop;

$R_{FB3}$ is the feedback resistor of the second loop;

$V_{LREG}$ is the LED regulation voltage; and $V_{REF}$ is the predetermined reference voltage; and comparing the feedback voltage with the predetermined reference voltage to regulate the LED power voltage.

10. The method of claim 9, further comprising:

deactivating one or more of the at least one activated LED strings; and maintaining a magnitude of the analog LED regulation voltage in response to deactivating one or more of the at least one activated LED strings.

11. The method of claim 9, wherein comparing the at least one LED voltage comprises comparing each of the at least one LED voltage with each of a predetermined high threshold voltage and a predetermined low threshold.

12. The method of claim 11, wherein determining whether the LED power voltage should one of increase and decrease comprises:

determining that the LED power voltage should increase in response to one or more of the at least one LED voltage being less than the predetermined low threshold voltage;

determining that the LED power voltage should decrease in response to all of the at least one LED voltage being greater than the predetermined high threshold voltage; and determining that the LED power voltage should maintain a current magnitude in response to none of the at least one LED voltage being less than the predetermined low threshold voltage and one or more of the at least one LED voltage being between the predetermined high and low threshold voltages via the command signal.

13. The method of claim 9, wherein regulating the LED power voltage comprises:

increasing the LED power voltage by a voltage increment at each sample of a first response rate based on determining that the LED power voltage should increase; and decreasing the LED power voltage by the voltage increment at each sample of a second response rate in response to determining that the LED power voltage should decrease, the first response rate being faster than the second response rate.

14. A light-emitting diode (LED) power supply system comprising:

a power converter configured to generate and regulate an LED power voltage that provides power to at least one activated LED string based on a feedback voltage relative to a predetermined reference voltage;

an LED regulator configured to monitor at least one LED voltage associated with a respective at least one activated LED string and to generate an LED regulation voltage that is indicative of whether the LED power voltage should one of increase to provide sufficient power for each of the at least one activated LED string, decrease to substantially minimize power consumption of each of the at least one activated LED string, and remain the same magnitude, the LED regulation voltage being combined with the LED power voltage via respective first and second feedback loops to generate the feedback voltage, the first feedback loop comprising a resistor ($R_{FB1}$) in series with a resistor ($R_{FB2}$) between the LED power voltage and a reference, the second feedback loop comprising the two feedback resistors of the first loop and a third resistor ($R_{FB3}$) according to the equation:

$$V_{LED}=(R_{FB1}+R_{FB2})/R_{FB2}*V_{REF}+R_{FB1}/R_{FB3}*(V_{REF}-V_{LREG})$$

in which $V_{LED}$ in the LED power voltage;

$R_{FB1}$ and $R_{FB2}$ are the feedback resistors of the first loop;

$R_{FB3}$ is the feedback resistor of the second loop;

$V_{LREG}$ is the LED regulation voltage; and $V_{REF}$ is the predetermined reference voltage.

15. The system of claim 14, wherein the LED regulator comprises a plurality of comparators configured to perform at least one comparison of each of the at least one LED voltage with at least one predetermined threshold voltage to generate a control signal based on the at least one comparison that is indicative of whether the LED power voltage should one of increase, decrease, and remain the same magnitude.

16. The system of claim 14, wherein the LED regulator is configured to change a magnitude of the LED regulation voltage by a voltage increment at each sample of a first response rate in response to determining that the LED power voltage should increase and to change the magnitude of the LED regulation voltage by the voltage increment at each sample of a second response rate in response to determining that the LED power voltage should decrease, the first response rate being faster than the second response rate.

17. The system of claim 14, wherein the LED regulator comprises:

a digital voltage controller configured to one of increase, decrease, and maintain a magnitude of a digital voltage signal corresponding to the LED regulator voltage;

a digital-to-analog controller (DAC) configured to convert the digital voltage signal to the LED regulation voltage; and circuitry configured to maintain the magnitude of the LED regulation voltage in response to one or more of the at least one activated LED string being deactivated.

* * * * *